US011473244B2

(12) United States Patent
Hoehsl et al.

(10) Patent No.: US 11,473,244 B2
(45) Date of Patent: Oct. 18, 2022

(54) CLOTHING FOR A MACHINE FOR PRODUCING A FIBROUS MATERIAL WEB

(71) Applicant: VOITH PATENT GMBH, Heidenheim (DE)

(72) Inventors: Matthias Hoehsl, Heidenheim (DE); Michael Straub, Steinheim (DE); Uwe Koeckritz, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 89 days.

(21) Appl. No.: 17/261,242

(22) PCT Filed: Jun. 5, 2019

(86) PCT No.: PCT/EP2019/064575

§ 371 (c)(1),
(2) Date: Jan. 19, 2021

(87) PCT Pub. No.: WO2020/015915

PCT Pub. Date: Jan. 23, 2020

(65) Prior Publication Data

US 2021/0269976 A1 Sep. 2, 2021

(30) Foreign Application Priority Data

Jul. 17, 2018 (EP) ..... 18183869

(51) Int. Cl.
*D21F 1/00* (2006.01)
*D21H 27/00* (2006.01)

(52) U.S. Cl.
CPC ..... *D21F 1/0063* (2013.01); *D21F 1/0045* (2013.01); *D21H 27/002* (2013.01)

(58) Field of Classification Search
CPC ..... D21F 1/0063; D21F 1/0045; D21F 7/083; D21F 7/10; D21F 1/0054; D21H 27/002
See application file for complete search history.

(56) References Cited

U.S. PATENT DOCUMENTS 4,446,187 A 5/1984 Eklund
5,837,102 A * 11/1998 Graf ..... D21F 1/0063 162/296
2010/0136286 A1 6/2010 Bez et al.

FOREIGN PATENT DOCUMENTS

DE 102007024847 A1 12/2008
DE 202010016701 U1 5/2011
(Continued)

OTHER PUBLICATIONS

Wuest, Carl, "Stamped flange with unique surface quality", Nov. 10, 2006 (Nov. 10, 2006), Maschinenmarkt Retrieved from: URL: https://www.maschinenmarkt.vogel.de/stanzflansche-mit-einmaliger-oberflaechenguete-a-48442/, XP002787749, [found on Jan. 9, 2019], the whole document.

(Continued)

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

Clothing is provided for a machine for producing a fibrous web, in particular a paper, board or tissue web. The clothing has a substrate. The substrate has a top side, an underside, two side edges and a useful region between the two side edges. The useful region has a plurality of through-channels, which connect the top side to the underside of the substrate. An inner surface of at least one through-channel, preferably of the majority of all the through-channels, more preferably of all the through-channels in the useful region of the substrate, has a mean roughness depth that is greater than 4 μm, preferably greater than 6 μm, more preferably greater than 8 μm. The clothing of this type is produced using a laser.

18 Claims, 3 Drawing Sheets

(56) References Cited

FOREIGN PATENT DOCUMENTS

| | | | | |
|---|---|---|---|---|
| DE | 102012210765 | A1 * | 1/2014 | ..... B23K 26/384 |
| DE | 102012210765 | A1 | 1/2014 | |
| EP | 3348708 | A1 | 7/2018 | |
| WO | 2014001217 | A1 | 1/2014 | |
| WO | 2015185278 | A1 | 12/2015 | |

OTHER PUBLICATIONS

Anonymous, "Surface—Roughness & Manufacturing Processes", technical drawing, Retrieved from URL: http://www.technisches-haben.net/technisches-haben/diverses/rauheit-fertigungsverfahren.php XP002787750, [found on Jan. 9, 2019].

* cited by examiner

CLOTHING FOR A MACHINE FOR PRODUCING A FIBROUS MATERIAL WEB

BACKGROUND OF THE INVENTION

Field of the Invention

The present invention relates to a clothing for a machine for producing a fibrous material web, in particular a paper web, cardboard web, or tissue web, comprising a substrate having an upper side, a lower side, two lateral peripheries, and a useful region between the two lateral peripheries, wherein the useful region has a multiplicity of passage ducts which connect the upper side to the lower side of the substrate. The present invention furthermore relates to a method for producing such a clothing.

In the industrial production and/or finishing of fibrous material webs, the fibrous material web is typically transported on one clothing or a plurality of clothings that continuously revolves/revolve in a machine. In a paper machine, for example, a fibrous material suspension from a headbox is first applied to a forming wire on which the actual fibrous material web is formed by dewatering, and is subsequently transported through a press section for further drying on a press felt, and is thereafter transported on a drying wire through a drying section of the paper machine before the completed paper web at the end of the paper machine can be rolled up or be directly further processed or finished, respectively. Apart from a few helical screens, woven fabrics, that is to say structures in which warp threads and weft threads are interwoven on a weaving loom, are predominantly used nowadays as before in practice for said clothings. Since this mode of production is relatively complex, the idea of producing such clothings in an entirely different way has been around for some time, specifically in that a substrate is perforated. The present invention is also based on this idea. Such a clothing in which the passage ducts have been incorporated into the substrate by means of a laser was already described in the 1980s and 1990s, for example in publications U.S. Pat. Nos. 4,446,187 and 5,837,102, respectively.

The term "substrate" herein according to the present invention is to be understood to be a planar structure which is typically produced from plastics material and which per se, that is to say without the incorporated passage ducts, is first and foremost substantially impermeable to liquid. The substrate becomes permeable to fluid only on account of the incorporation of the passage ducts and the substrate is thus imparted its important capability of being able to discharge water from the fibrous material suspension, or from the fibrous material web, respectively. The substrate herein can be substantially a monolithic plastics material film which is produced by extrusion or molding, for example, or alternatively be a laminate which comprises a plurality of layers. These layers can be co-extruded, for example, or can be produced entirely separately from one another and only later be subsequently connected to one another. The longitudinal ends of the substrate are preferably connected to one another by welding so as to render the clothing continuous. Depending on the envisaged intended application, the clothing can either be composed substantially only of the perforated substrate or can have further layers such as, for example a non-woven layer, for instance for producing a press felt.

The useful region of the substrate refers to the region on which the fibrous material web is actually formed and/or transported. The useful region can extend across the entire width of the substrate or else only across a smaller region which is spaced apart from the lateral peripheries.

In particular when such a clothing is used as a forming wire, it is important that the clothing while forming the sheet enables a positive formation. A positive formation is typically present in particular when no marks arise in the fibrous material web being formed. However, it has been a phenomenon of laser-drilled substrates that has been observed over a long period of time that the material of the substrate that remains between the individual passage ducts has prevented uniform dewatering of the fibrous material suspension across the paper side of the substrate and a certain degree of marking has thus been inevitable. This problem has only been able to be solved by the teaching which is described in the subsequently published European patent applications EP18168641.1 and EP18168641.1 by the applicant, the disclosure of said patent applications hereby being fully incorporated by reference. According to this teaching, the passage ducts which are configured so as to be substantially funnel-shaped are disposed so tightly beside one another in the substrate that directly neighboring passage ducts at least contact one another, preferably overlap one another, on the paper side of the substrate. Despite the substrate being weakened on account of the tight disposal of the passage ducts, it has been demonstrated that the structural residual stability of the substrate is sufficient for the requirements in the forming section of a paper machine. When directly neighboring passage ducts overlap each other to a sufficient extent on the paper side of the substrate, a topography which is substantially similar to the interior of an egg box can be formed on this paper side. In other words, after the incorporation of the passage ducts, in particular by means of a laser, on the paper side of the substrate, the originally smooth surface completely, or at least almost completely, disappears such that only the mutually contacting peripheries that delimit the passage ducts substantially remain as more or less thin webs on the paper side. The circumferential periphery herein forms a contour which does not lie in one plane. In this way, a very large open face can be provided for the fibrous material suspension on the paper side of the substrate such that decidedly uniform dewatering can take place, this counteracting the marking tendency of the clothing. The fibers from the fibrous material suspension herein are deposited across the passage ducts on the circumferential peripheries of the latter, while the water can flow out through the passage ducts. The machine side of the substrate, opposite the paper side, can still be present as a largely planar face and thus provide a sufficient contact face so as to transmit the drive forces of rollers of the paper machine onto the substrate without any noticeable slippage.

However, excessively rapid dewatering of the fibrous material suspension can arise on account of the very large open face on the paper side of the substrate, said excessively rapid dewatering being in any case more rapid than is the case in the usual laser-drilled substrates in which the individual passage ducts are mutually spaced apart. Excessively rapid dewatering is however associated with specific disadvantages. For example, fillers which are contained in the fibrous material suspension and are to remain in the fibrous material web are excessively washed out, this in turn compromising the quality of the formation. It can furthermore arise that the forming wire very rapidly runs dry, this leading to an increased requirement of energy for operating the paper machine and to increased wear on the clothing. For this reason, a moderate to slow dewatering performance of the clothing is to be preferred.

SUMMARY OF THE INVENTION

It is thus an object of the present invention to eliminate the aforementioned disadvantages. In particular, the present clothing is to be easy to produce and have a moderate dewatering rate. If the clothing according to the invention is used as a forming wire, a particularly positive formation of the fibrous material web being formed thereon is to be able to be achieved.

This object is achieved by the features of the independent clothing claim, relating to a clothing according to the invention, as well as by the features of the independent method claim, relating to the production of such a clothing. Advantageous refinements of the invention are the subject matter of the dependent claims.

The generic clothing mentioned at the outset is distinguished according to the present invention in that the internal surface of at least one passage duct, preferably of the majority of all passage ducts, furthermore preferably of all passage ducts, in the useful region of the substrate has/have a mean roughness depth $R_z$ which is more than 4 μm, preferably more than 6 μm, furthermore preferably more than 8 μm. Experiments have demonstrated that the roughness of the internal surface of the passage ducts has a noticeable effect on the dewatering rate of the fibrous material web. It applies in principle here that the greater the roughness, the lower the dewatering rate.

As is known to the person skilled in the art, the mean roughness depth $R_z$ is determined in that a defined measured length on the internal surface of a passage duct is divided into seven individual measured lengths, wherein the central five measured lengths are of identical size. The evaluation takes place only by way of these five measured lengths because the Gauss filter to be applied requires a preliminary or follow-up distance of half an individual measured length, or a crease has a run-in and run-out behavior that cannot be neglected, respectively. The difference from the maximum value and the minimum value is determined from each of these individual measured lengths of the profile. The mean value is formed from the thus five individual roughness depths thus obtained.

The measurement of the roughness can take place in a classical manner as a tactile measurement of 2-D profile sections. Reference to this end is made to standards DIN EN ISO 4287 and 4288. Investigations carried out at the behest of the applicant have demonstrated that the mean roughness depth $R_z$ of the internal surface of a passage duct of laser-drilled substrates can be more easily determined by a 3-D detection of the face under investigation by means of optical measuring technology. Reference in this context is made to standard DIN EN ISO 25178. It is specifically proposed that for determining the mean roughness depth $R_z$, the substrate is first cut open, wherein the section preferably comprises the central axis of the passage duct of which the internal surface is to be investigated. The internal surface is subsequently measured in three dimensions by means of a suitable optical apparatus such as, for example, the confocal microscope DCM 3D by the Leica® company. In confocal microscopy, measuring takes place by the point-to-point method of a respective point of the internal surface. On account of the 3-D coordinates thus obtained, the 2-D sectional surfaces can then be defined, from which vertical profiles and roughness values can in turn be obtained.

The clothing according to the invention is preferably a forming wire, or is used as such a forming wire, respectively. Furthermore, the passage ducts can advantageously have a shape and be disposed in the substrate such as described at the outset in the context of the subsequently published European patent applications EP18168641.1 and EP18168641.1 by the applicant. The passage ducts can in particular be configured so as to be substantially funnel-shaped. In the context of the present application this is to be understood to mean that the passage ducts, proceeding from the paper side of the substrate, in the thickness direction of the substrate taper, preferably continuously, toward a central region which lies between the paper side and the machine side, or between the upper side and the lower side of the substrate, respectively, or even toward the machine side. While a deceleration of the flow rate in the passage duct is indeed already achieved on account of this funnel-shaped taper, the taper cannot be configured in an arbitrarily intense manner. Specifically, if the entry opening on the paper side or upper side, respectively, of the substrate becomes excessively large, fibers from the fibrous material suspension that are to be retained by the substrate can indeed be suctioned into the passage duct. If the exit opening of the passage duct on the machine side or lower side, respectively, of the substrate becomes excessively small, the passage duct can rapidly clog up on account of washed-out fillers in the fibrous material suspension. The setting of the roughness of the internal surface of the passage duct according to the invention is therefore of essential importance when optimizing the flow rate in the passage duct of the substrate.

Since the dewatering of the fibrous material web should also not take place too slowly, on the other hand, it is proposed that the mean roughness depth $R_z$ is less than 20 μm, preferably less than 15 μm. In the case of an excessively slow dewatering, the fibrous material web, at least when the clothing according to the invention is used as a forming wire of a paper machine, is transferred to the press section and subsequent drying section with excessive residual moisture, which is disadvantageous in terms of the energy consumption of the paper machine.

It is furthermore proposed that the substrate is a laser-drilled substrate, wherein the passage ducts are incorporated into the substrate by means of a laser. Typically, it can be clearly seen in the completed clothing in which way the passage ducts were incorporated into the substrate, whether by punching, for example, or by mechanical drilling or laser-drilling. Melting and/or sublimation of the substrate material arises when laser-drilling, wherein part of the evaporated material usually precipitates again as a condensate on the substrate. This leaves behind characteristic traces in the bore hole and about the bore hole. If the substrate of the clothing according to the invention is a laminate which is composed of more than one layer, the feature "laser-drilled" substrate is to be understood to mean that the completed laminate has been perforated by a laser. Ideas according to which passage ducts can first be incorporated into the individual layers of the laminate, wherein the passage ducts of the individual layers can have dissimilar diameters, and these layers are only subsequently connected to one another, are impractical in particular because it is not possible for the individual layers to be brought in mutual alignment with the required precision in order for passage ducts which connect the upper side to the lower side of the completed substrate to be reliably configured all over. To this extent, such embodiments are explicitly not to be understood as "laser-drilled substrates" in the context of the present invention; if at all, however, the individual layer in such a laminate could be understood to be a "laser-drilled substrate".

One advantageous refinement of the invention provides that the ratio between a minimum diameter of the passage ducts and a thickness of the substrate is between 1:3 and 1:10, preferably between 1:4 and 1:8, furthermore preferably between 1:5 and 1:7. The effect which in the form of throttling the flow rate is exerted by the roughness of the internal surface of the passage duct truly comes to bear when the thickness of the substrate is at least four times the minimum diameter of the passage duct. In contrast, the roughness does not lead to a reduction in the flow rate to the same extent in the case of minor thicknesses of the substrate. To this end, the skills pertaining to pressure losses in perforated plates that are passed through by a flow can be used for the purpose of approximation. The minimum diameter of a passage duct may be described as the minimum spacing from one point of the internal surface to an opposite point of the internal surface of the passage duct, wherein measuring takes place in a plane that is parallel to the plane of the substrate. The thickness of the substrate describes the spacing between the upper side and the lower side of the substrate. If the upper side of the substrate no longer has a smooth face that lies in one plane once the passage ducts have been incorporated into the substrate, the highest point of the upper side, thus the point which has the largest spacing from the lower side of the substrate, is to be used, wherein it is assumed herein that the lower side of the substrate still has a substantially smooth face that lies in one plane.

The substrate preferably has a thickness between 500 μm and 1500 μm, furthermore preferably between 600 μm and 1200 μm, and even furthermore preferably between 800 μm and 1000 μm. The corresponding dimension of the passage ducts is then based on these values.

Providing the internal surface of a passage duct according to the present invention with a mean roughness depth $R_z$ of more than 4 μm, preferably more than 6 μm, furthermore preferably more than 8 μm, is not a trivial matter. For example, internal surfaces which have a noticeably lower mean roughness depth $R_z$ are thus created without any further preparatory arrangements when laser-drilling passage ducts in a plastics material substrate which is formed from PP or PET or PA, for example. Therefore, two specific ideas with the aid of which such a high mean roughness depth $R_z$ can be reliably generated will be proposed hereunder. These two ideas here can be applied alternatively or in combination.

As the first idea it is proposed that the substrate, besides a matrix material, furthermore has filler particles, wherein the material of the filler particles when irradiated with laser light is able to be brought to the gas phase more slowly or rapidly than the matrix material. In this way it is possible for the internal surface of a laser-drilled passage duct to be provided with protrusions and/or recesses which act as a kind of "turbulence generator" for the liquid flowing through the passage duct. The flow rate is reduced on account of the turbulences thus incorporated into the passage duct. The matrix material herein, besides the fillers, can contain even further substances and thus be configured as a composite material, for example.

In a refinement of this first idea it is proposed that the filler particles have a mean diameter between 20 μm and 150 μm, preferably between 50 μm and 100 μm, wherein the filler particles are preferably configured so as to be substantially spherical.

As has already been described above, the substrate can be a laminate formed from a plurality of layers. In particular, the substrate can be formed from a plurality of layers, preferably from 2 to 6 layers, furthermore preferably from 3 to 5 layers. By using a plurality of thin layers instead of a single thick layer it is possible to incorporate higher tensile strengths into the substrate, because individual thinner layers can be more heavily stretched in a (bi-)axial manner than a single thick layer.

In this case, the desired roughness can be achieved according to the second specific idea when a basic shape of the passage ducts at a border between two neighboring layers of the substrate has an offset in a direction which lies in the plane of the substrate. The offset herein acts as a turbulence generator for the flow in the passage duct. "Basic shape" herein is to be understood to be the shape of the passage ducts which the latter would have in the absence of the offset. The basic shape can correspond substantially to the geometric shape of a frustum, for example, or in the extreme case also to that of a straight circular cylinder. On account of the offset at least one border between two neighboring layers, preferably at all borders between two respective neighboring layers, this basic shape is distorted by the corresponding offset. Credit goes to the inventors for having found a way to be able to reliably generate such an offset in laser-drilled substrates which are formed from a laminate comprising a plurality of layers, wherein the corresponding production method will be discussed in more detail hereunder.

In the regions of the passage ducts between the borders to the neighboring layers, the mean roughness depth $R_z$ can be such as would normally arise when laser-drilling a substrate without any particular preparatory arrangements. In particular, the mean roughness depth $R_z$ of the internal surface of at least one passage duct, preferably of a majority of all passage ducts, furthermore preferably of all passage ducts, in the useful region of the substrate within the region of at least one layer can be less than 4 μm, preferably less than 3 μm, furthermore preferably less than 2 μm, or even less than 1 μm.

According to a further aspect, the present invention relates to a method for producing a clothing as described above, wherein the method is distinguished in that at least one passage duct, preferably the majority of all passage ducts, furthermore preferably all passage ducts, in the useful region of the substrate is/are incorporated into the substrate by means of a laser.

The advantages of the invention that have been described in the context of the clothing according to the invention also apply to the manufacturing method according to the invention, and vice versa.

According to the afore-described first idea, it is proposed that, prior to the step of incorporating the passage ducts, the substrate is formed in that filler particles are added to a matrix material which forms the main component part of the substrate, wherein the material of the fillers particles when irradiated with laser light is able to be moved more slowly or rapidly to the gas phase than the matrix material.

The substrate herein can have a plurality of layers, wherein the concentration of the filler particles differs between at least two of these layers. In this way it is possible for the reduction rate for dewatering the passage ducts to be set more finely. Furthermore, the outermost layer of the substrate on the upper side or paper side, respectively, and/or the outermost layer of the substrate on the lower side or machine side, respectively, can be free of filler particles so as not to cause any undesirable effects when contacting the fibrous material web or machine parts, respectively. In other words, only one central layer or a plurality of central layers can have a filler material.

According to the afore-described second idea it is proposed that the substrate is formed from a plurality of layers, wherein the individual layers are connected to one another by means of an auxiliary agent, in particular an adhesive layer, wherein the substrate is subsequently rolled up and unrolled again in order for the passage ducts to be incorporated. The adhesive can preferably be a solvent-based polyester resin. The inventors have discovered by means of tests that, at a border between two neighboring layers of the substrate, it is in this way possible to impart the basic shape of the passage ducts in a simple and reproducible manner an offset in a direction that lies in the plane of the substrate. This can be explained in that internal stresses are incorporated into the auxiliary agent, in particular the adhesive, that is disposed between two neighboring layers, when laminating and subsequently rolling up, said internal stresses being relieved again within a short time on account of the unrolling and the thermal input when laser-drilling. The protrusions and recesses thus created for the flow in the passage duct lead to an increase in the mean roughness depth $R_z$ of the internal surface of the passage duct. Said protrusions and recesses serve as turbulence generators for the flow and thus lead to the desired throttling of said flow.

In tests it has proven advantageous for the substrate in the region in which the passage ducts are being incorporated into the substrate by means of the laser to be applied, preferably by means of a vacuum, to a substantially planar face. To this end, a so-called vacuum table can be used, for example.

It is furthermore preferable for the passage duct or the passage ducts to be incorporated into the substrate by means of a single pulse of the laser. While more than one pulse may also be used, tests have nevertheless shown that the opening angle of the substantially frustoconical passage ducts becomes very large when a plurality of pulses are used, this potentially being disadvantageous in terms of the structural stability of the completed product.

The invention will be further explained hereunder by means of schematic drawings which are not to scale.

DETAILED DESCRIPTION OF THE INVENTION

Figure 1:
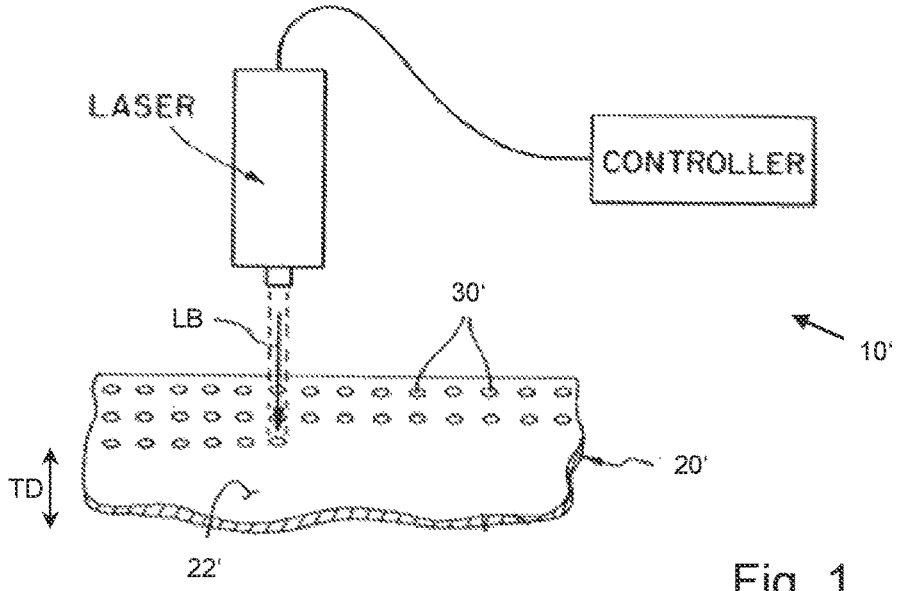
Fig. 1 PRIOR ART
FIGS. 1 and 2 show a device known from the prior art for perforating a substrate by means of a laser.
Figure 2:
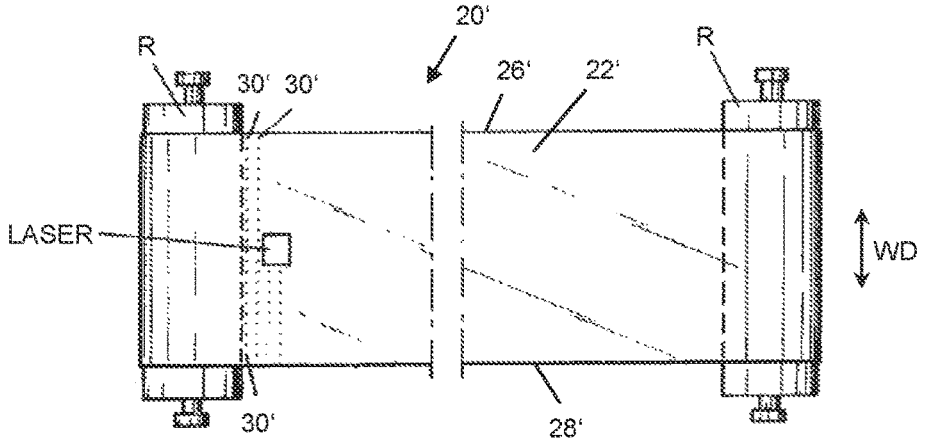
Fig. 2 PRIOR ART
Figure 3A:
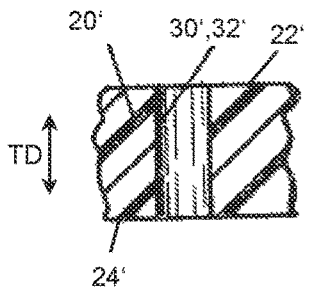
Fig. 3A PRIOR ART
FIGS. 3*a*-3*c* shows various bore hole geometries known from the prior art.
Figure 3B:
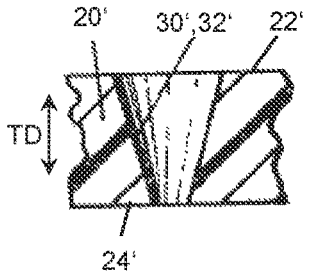
Fig. 3B PRIOR ART
Figure 3C:
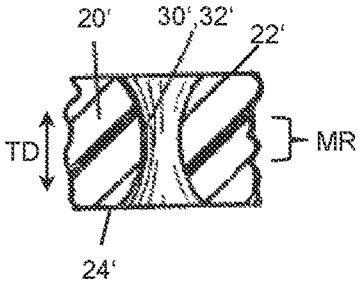
Fig. 3C PRIOR ART

FIGS. 1 and 2 schematically show a device 10' known from the prior art, or a method for drilling passage ducts 30' into a substrate 20' by means of a laser, respectively. The laser herein is actuated by a computer or a controller. Said laser emits a laser beam LB perpendicularly onto the upper side 22' of the substrate 20'. As can be seen in particular in FIGS. 3*a*-3*c*, passage ducts 30' of dissimilar design can be generated by melting and/or sublimating the material of the substrate 20' with the laser, said passage ducts 30' in the thickness direction TD of the substrate 20' extending from the upper side 22' to the lower side 24'. The substrate 20' is composed of a plastics material film which per se, that is to say prior to the perforation by the laser, is initially impermeable to liquid. The passage duct 30' in FIG. 3*a* has the shape of a straight circular cylinder. In contrast, the passage duct 30' in FIG. 3*b* has the shape of a frustum which tapers from the upper side 22' to the lower side 24' of the substrate 20'. The passage duct 30' in FIG. 3*c* has an hourglass-shaped design, thus a design in which the diameter of the passage duct 30', proceeding from the upper side 22', initially tapers toward a central region MR of the substrate 20' that is disposed between the upper side 22' and the lower side 24', and thereafter, proceeding from the central region MR, widens again toward the lower side 24' of the substrate.

FIG. 2 shows how a continuous substrate 20' that is tensioned across two rollers R is perforated with a multiplicity of passage ducts 30' by means of the laser, said passage ducts 30' being disposed in a substantially checkered manner. The laser herein moves continuously from a lateral periphery 26' to the lateral periphery 28' of the substrate 20' that in the width direction WD is opposite, and back or vice versa, respectively, so as to drill the passage ducts 30'. The passage ducts 30' herein can be uniformly distributed across the entire width, or else the perforated useful region of the substrate 20' is narrower, depending on the desired specific application. The substrate 20' can already represent the completed clothing, for example the completed forming wire of a paper machine, or else may be even further processed. For example, said substrate 20' can still be provided with at least one layer of staple fibers so as to be used as a press felt in a paper machine. Or else webs of the substrate 20' can be spiraled in order to be able to achieve larger widths of the clothing.

The respective internal surface 32' of the passage duct 30' in the case of this production mode and without any particular preparatory arrangements being made is at all times substantially smooth, that is to say has a mean roughness depth $R_z$ of significantly less than 4 μm. In particular when the passage ducts are disposed so close next to one another that said passage ducts contact or even overlap one another on the upper side 22' of the substrate 20', a smooth wall can have a negative effect because excessively rapid dewatering of the fibrous material web which is transported on the clothing takes place on account thereof. The reduction of the dewatering rate is achieved according to the invention in that the roughness of the internal surface 32 of the passage duct 30 is enlarged in a highly targeted manner.

Figure 4A:
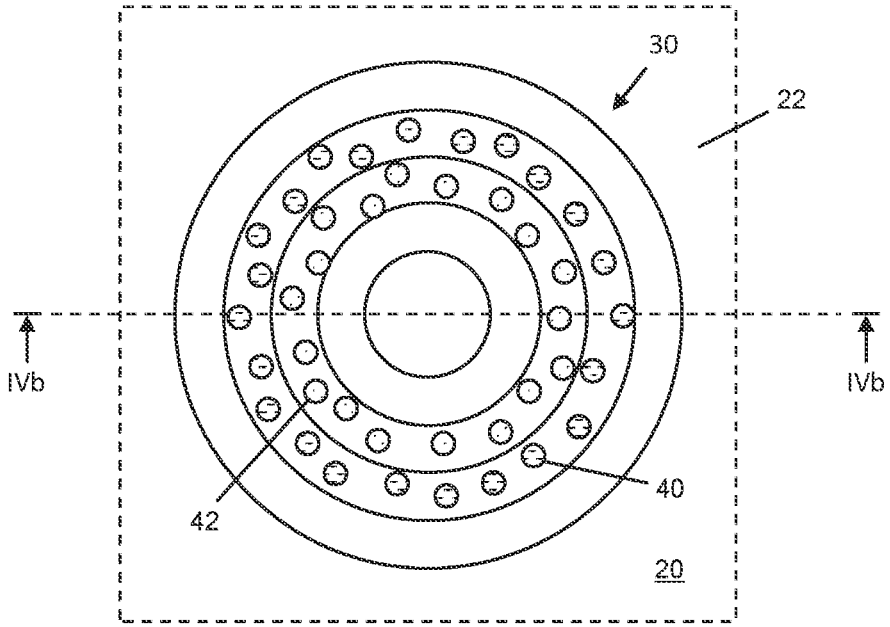
FIGS. 4*a* and 4*b* show a first embodiment of a passage duct in a clothing according to the invention.
Figure 4B:
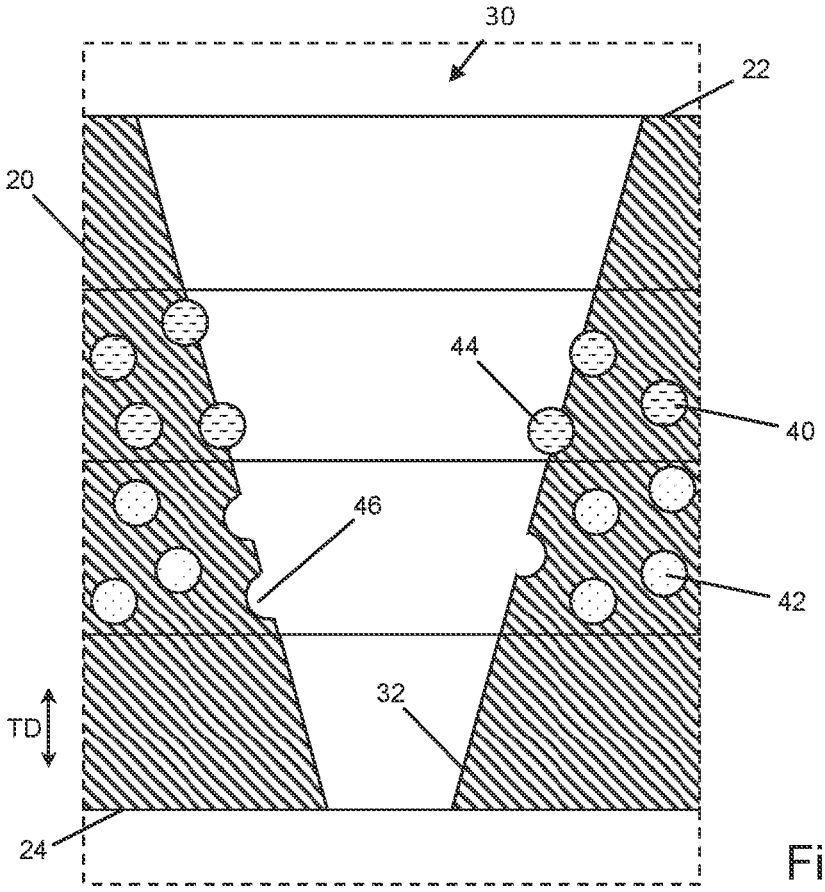

FIGS. 4*a* and 4*b* show a fragment of the substrate 20 having a single passage duct 30 according to a first exemplary embodiment of the present invention, said fragment being bordered by a dashed line. FIG. 4*a* herein shows a plan view onto the upper side 22 of the substrate 20, whereas FIG. 4*b* shows a sectional view along the sectional plane IVb-IVb from FIG. 4*a*. The substrate 20 in this exemplary embodiment is a laminate formed from four layers, wherein all the individual layers can have a substantially identical thickness, that is to say the same dimension in the thickness direction TD. The individual layers herein can be connected to one another with an adhesive. The substrate is composed substantially of a polymer basic material. However, as a particularity, in this embodiment filler particles 40, 42 are however added to the two central layers of the substrate 20, wherein the one of the two central layers can comprise exclusively filler particles 40 of a first type, and the other of the two central layers can comprise exclusively filler particles 42 of a second type which is dissimilar to the first type.

In theory, both layers could however also comprise the same type of filler particles 40, 42 or both types of filler particles 40, 42. It is to be pointed out that these filler particles in the figures are illustrated only in a schematic and not true-to-scale manner.

The filler particles 40 of the first type in comparison to the matrix material of the substrate 20 have the property that said filler particles 40, when irradiated with laser light, move less rapidly, or not at all, to the melt phase and/or vapor phase. Therefore, these filler particles 40 remain as protrusions 44 on the internal surface 32 of the laser-drilled passage duct 30 and thus ensure turbulences in the flow of the fluid which in the intended use of the clothing according to the invention flows through the passage ducts 30.

The filler particles 42 of the second type in comparison to the matrix material of the substrate 20 have the property that said filler particles 42, when irradiated with laser light, move significantly faster or easily, respectively, to the melt phase and/or vapor phase. Therefore, these filler particles 40 when vanishing leave behind recesses 46 on the internal surface 32 of the laser-drilled passage duct 30 and in this way likewise ensure turbulences in the flow of the fluid which in the intended use of the clothing according to the invention flows through the passage ducts 30.

The roughness of the internal surface 32 of the passage duct 30 and thus the throttling effect on the flow can be set by way of the density of the concentration of the filler particles 40, 42 in the matrix material of the substrate. The mean roughness depth $R_z$ of the internal surface 32 of the passage duct 30 herein is enlarged according to the invention to more than 4 μm, preferably more than 6 μm, furthermore preferably more than 8 μm. The two outermost layers of the substrate 20 in this exemplary embodiment are free of filler particles 40, 42. This is indeed advantageous for preventing the filler particles from developing an undesirable effect when said filler particles in the intended use of the clothing according to the invention come into direct contact with the fibrous material web to be dewatered or with parts of the machine, but this is not mandatory. Conversely, at least one of the two outermost layers can however also contain fillers in a targeted manner, specifically in particular when the fillers serve as release agents.

It is to be noted that the filler particles 40, 42 shown here have a substantially spherical basic shape. This is however likewise not mandatory.

Figure 5A:
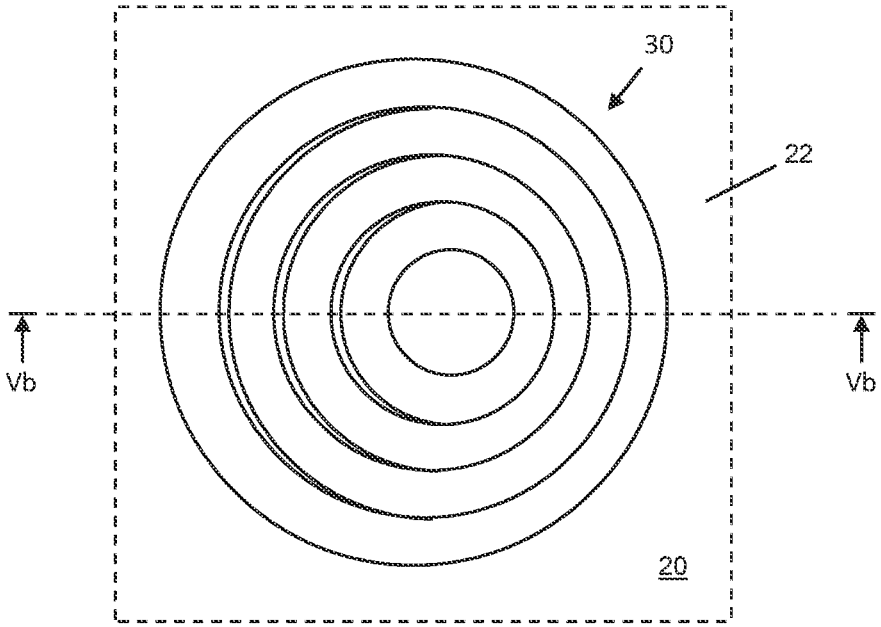
FIGS. 5*a* and 5*b* show a second embodiment of a passage duct in a clothing according to the invention.
Figure 5B:
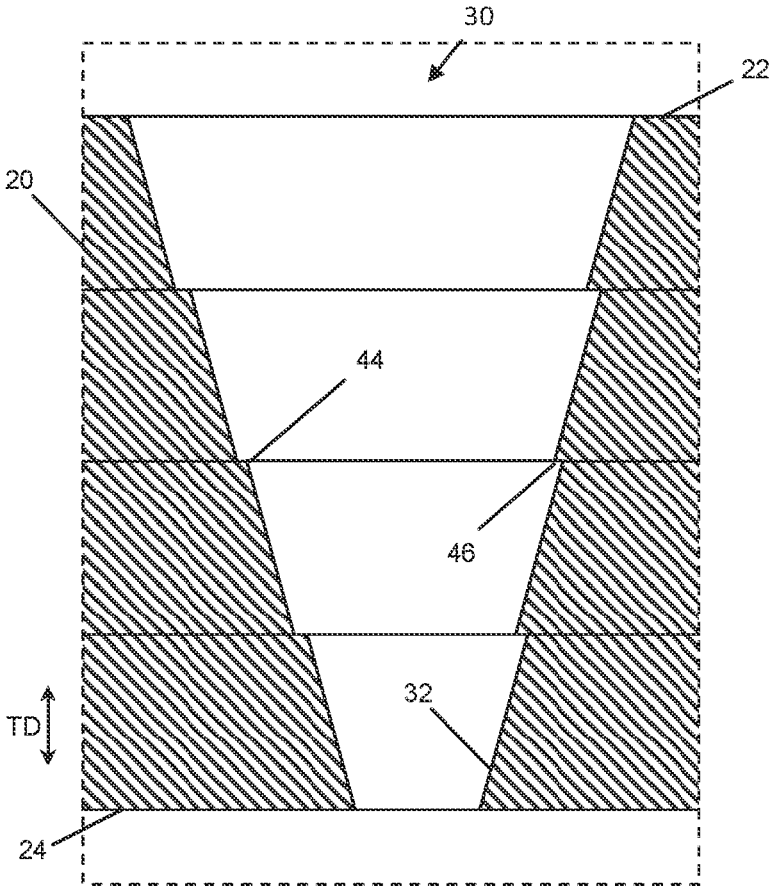

A portion of a substrate 20 having a passage duct 30 according to a second embodiment is shown in FIGS. 5*a* and 5*b*. FIG. 5*a* herein again shows a plan view onto the upper side 22 of the substrate 20, and FIG. 5*b* shows a sectional view through the passage duct 30 along the section plane V-V in FIG. 5*a*. The particular features of this second embodiment can be used alternatively to or in combination with the particular features of the first embodiment.

The substrate 20 also in this example is formed as a multi-layer laminate, wherein four layers are present here, the extent of said layers in the thickness direction TD being substantially identical. The particularity of this embodiment is that the basic shape of the passage duct 30 that here corresponds substantially to a frustum which tapers from the upper side 22 to the lower side 24 of the substrate 20 has an offset at the respective borders between two directly neighboring layers of the substrate. This offset leads to protrusions 44 and recesses 46 in the passage duct 30 for the liquid which in the intended use of the clothing according to the invention flows through the passage duct. On account thereof, turbulences which reduce the flow rate in the passage duct 30 are incorporated into the liquid. The protrusions 44 and the recesses 46 ensure that the mean roughness depth $R_z$ of the internal surface 32 of the passage duct becomes more than 4 μm, preferably more than 6 μm, furthermore preferably more than 8 μm. In contrast, the mean roughness depth $R_z$ is again significantly less in the region between two neighboring layer borders. To the extent that the mean roughness depth $R_z$ is to be enlarged also in these regions, the afore-described features of the first exemplary embodiment can be resorted to, for example. However, attention has to be paid to the flow rate in the passage duct 30 not being excessively throttled so that appropriate dewatering of the fibrous material web which in the intended use of the clothing according to the invention is transported on the substrate can take place.

As the inventors have found, the protrusions 44 and the recesses 46 in this embodiment can be reliably and reproducibly generated in that the individual layers of the laminate are connected to one another, or laminated, respectively, by way of an adhesive, preferably a solvent-based polymer resin, the laminate is subsequently rolled up, unrolled again in order to be laser-drilled, and is tensioned on a flat plane substantially in the region of the bore. This effect can be explained by internal stresses in the material which are released again within a short time on account of the effect of heat and force. This effect can be utilized in a targeted manner in order for the roughness in the passage duct 30 to be increased and to thus reduce the flow rate through the passage duct 30.

The present invention has a particularly advantageous effect when the clothing is a forming wire and when the individual passage ducts 30 are placed so tightly beside one another that said passage ducts 30 at least contact, preferably overlap, one another on the upper side 22 or the paper side, respectively, as has been described at the outset.

In the two exemplary embodiments of the present invention shown here the basic shape of the passage duct 30 is always substantially frustoconical. This is however not mandatory. In practice, the passage ducts 30 can also have a basic shape which deviates therefrom to a greater or lesser extent.

LIST OF REFERENCE SIGNS

10' Device
20', 20 Substrate
22', 22 Upper side
24', 24 Lower side
26' Lateral periphery
28' Lateral periphery
30', 30 Passage duct
32', 32 Internal surface
40 Filler particles of a first type
42 Filler particles of a second type
44 Protrusion
46 Recess
LB Laser beam
MR Central region
R Roller
TD Thickness direction

The invention claimed is:

1. A clothing for a machine for producing a fibrous material web, the clothing comprising:

a substrate having an upper side, a lower side, two lateral peripheries, and a region between said two lateral peripheries, said region having a plurality of passage ducts formed therein connecting said upper side to said lower side of said substrate, wherein an internal surface of at least one of said passage ducts in said region of said substrate has a mean roughness depth of more than 4 μm and less than 20 μm.

2. The clothing according to claim 1, wherein:

said substrate is a laser-drilled substrate; and said passage ducts are incorporated into said substrate by means of a laser.

3. The clothing according to claim 1, wherein a ratio between a minimum diameter of said passage ducts and a thickness of said substrate is between 1:3 and 1:10.

4. The clothing according to claim 1, wherein said substrate has a matrix material with filler particles, wherein a material of said filler particles when irradiated with laser light is able to be brought to a gas phase more slowly or rapidly than said matrix material.

5. The clothing according to claim 4, wherein said filler particles have a mean diameter between 20 μm and 150 μm.

6. The clothing according to claim 1, wherein said substrate is formed from a plurality of layers.

7. The clothing according to claim 6, wherein a basic shape of said passage ducts at a border between two neighboring said layers of said substrate has an offset in a direction which lies in a plane of said substrate.

8. The clothing according to claim 6, wherein the mean roughness depth of said internal surface of at least one of said passage ducts in said region of said substrate within a region of at least one of said layers is less than 4 μm.

9. The clothing according to claim 1, wherein:

the fibrous material web is a paper web, a cardboard web, or a tissue web; and said internal surface of all said passage ducts in said region of said substrate has the mean roughness depth being more than 8 μm.

10. The clothing according to claim 1, wherein the mean roughness depth is less than 15 μm.

11. The clothing according to claim 1, wherein a ratio between a minimum diameter of said passage ducts and a thickness of said substrate is between 1:5 and 1:7.

12. The clothing according to claim 4, wherein:

said filler particles have a mean diameter between 50 μm and 100 μm; and said filler particles are configured to be substantially spherical.

13. A method for producing a clothing, which comprises the steps of:

providing a substrate having an upper side, a lower side, two lateral peripheries, and a region between the two lateral peripheries, the region having a plurality of passage ducts formed therein connecting the upper side to the lower side of the substrate, wherein an internal surface of at least one of the passage ducts in the region of the substrate has a mean roughness depth of more than 4 μm and less than 20 μm; and incorporating at least one of the passage ducts in the region of the substrate into the substrate by means of a laser.

14. The method according to claim 13, wherein prior to the step of incorporating the passage ducts, forming the substrate by adding filler particles to a matrix material which forms a main component part of the substrate, a material of the filler particles when irradiated with laser light is able to be moved to a gas phase more slowly or rapidly than the matrix material.

15. The method according to claim 14, which further comprises forming the substrate with a plurality of layers, wherein a concentration of the filler particles differs between at least two of the layers.

16. The method according to claim 13, which further comprises:

forming the substrate from a plurality of layers, wherein the layers are connected to one another by means of an auxiliary agent; and subsequently rolling up the substrate again for the passage ducts to be incorporated.

17. The method according to claim 16, wherein the substrate in a region in which the passage ducts are being incorporated into the substrate by means of the laser is applied to a substantially planar face.

18. The method according to claim 13, wherein at least one of the passage ducts is incorporated into the substrate by means of a single pulse of the laser.

* * * * *